US005364022A

United States Patent [19]

Ganz

[11] Patent Number: 5,364,022

[45] Date of Patent: Nov. 15, 1994

[54] CLOSURE PANEL LOCK MECHANISM

[75] Inventor: Robert H. Ganz, Saddle River, N.J.

[73] Assignee: Riverwood International, Inc., Atlanta, Ga.

[21] Appl. No.: 93,484

[22] Filed: Jul. 19, 1993

[51] Int. Cl.[5] ..... B65D 5/30

[52] U.S. Cl. ..... 229/198.2; 229/103.2; 493/139

[58] Field of Search ..... 206/140; 229/198.2, 229/40, 155, 156, 157, 158, 148, 149; 493/137, 139

[56] References Cited

U.S. PATENT DOCUMENTS

| | | | |
|---|---|---|---|
| 2,990,997 | 7/1961 | Weiss | 229/40 |
| 3,249,284 | 5/1966 | Wood | 229/40 |
| 3,356,282 | 12/1967 | Layne, Sr. | 229/40 |
| 4,476,977 | 10/1984 | Manizza | 229/40 |
| 4,600,140 | 7/1986 | Milliens | 229/40 X |
| 4,708,284 | 11/1987 | Sutherland et al. | 229/40 |
| 4,723,699 | 2/1988 | Brown et al. | 229/40 |
| 4,989,779 | 2/1991 | Lashyro | 206/140 X |
| 5,004,147 | 4/1991 | Bienaime | 229/198.2 |
| 5,180,200 | 1/1993 | Shimizu | 229/40 X |

*Primary Examiner*—Allan N. Shoap
*Assistant Examiner*—Christopher McDonald
*Attorney, Agent, or Firm*—Charles E. Brown

[57] ABSTRACT

This relates to an improvement in a lock for closure panels of a carton of a wrap around type. Most specifically, the lock is formed between a male panel and a female panel of an overall closure panel with the male panel being provided with a projecting tab and the female panel having a folded down terminal panel portion with a cutout therein which receives the tab. With the lock so partially formed, scores or creases are rolled into the tab after which the tab is first folded down alongside the terminal panel portion of the female panel and then the folding of the tab is continued so as to swing the terminal female panel portion up beneath the male panel with a nose of the projecting tab passing through a slot in the male panel.

14 Claims, 3 Drawing Sheets

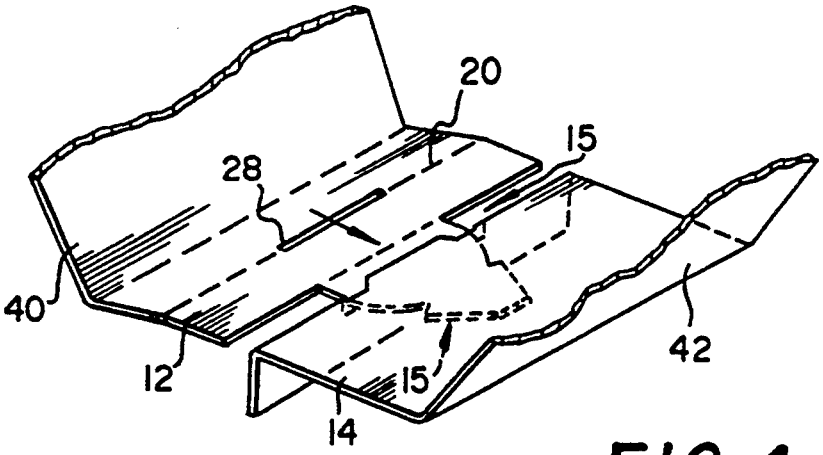
FIG. 4
FIG. 5
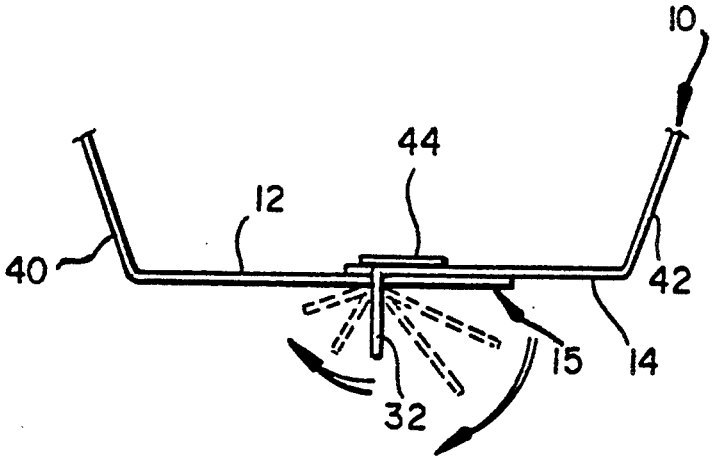
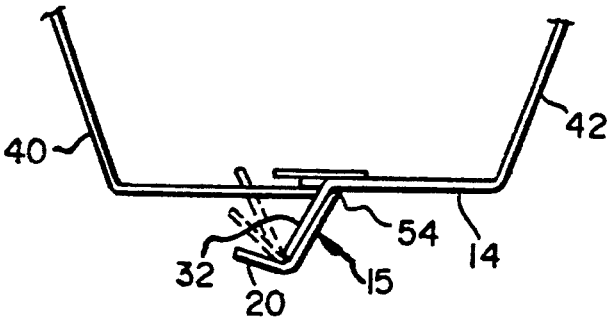
FIG. 8
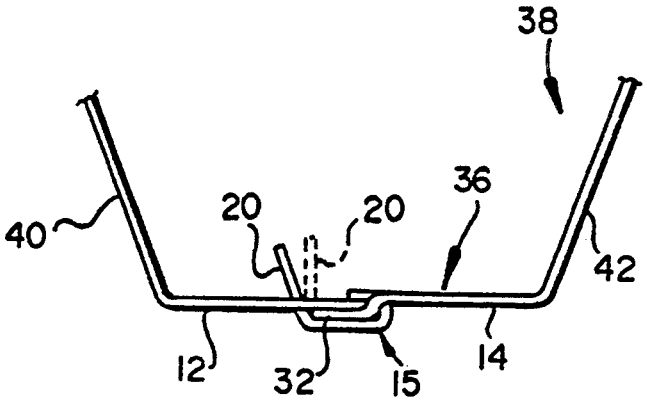
FIG. 9

CLOSURE PANEL LOCK MECHANISM

This invention relates in general to new and useful improvements in wrap around cartons and more particularly to a lock mechanism for locking together closure panels of such cartons.

BACKGROUND OF THE INVENTION

It is customary to provide cartons of the wrap around types which are preferably formed of paperboard and the like. Such cartons have two terminal panels which are folded into substantially coplanar relation and are locked together by means of integral locking means including at least one locking tab. Such closure panels and locks have a deficiency in that the resultant closure panel is of a predetermined width whereas the size of containers or like products enclosed in such cartons may vary slightly to provide either an over tight condition or a loose condition. The loose condition, particularly, is highly undesirable.

GENERAL DISCUSSION OF INVENTION

In accordance with this invention, the closure panels include a male panel having a projecting tab and a female panel having a terminal panel portion which is generally folded at right angles to the remainder of the female panel and is provided with a cutout through which the tab is projected. Thereafter, the tab is reversely folded down and around the terminal panel portion and then up through a slot formed in the male panel with the terminal panel portion being folded up into tight underlying relation with respect to the male panel.

A particular feature of the lock is the ability to vary the effective width of the overall closure panel in accordance with the size of the product or products encased within the carton. This is particularly accomplished by, after passing the tab through the cutout and tightly drawing together sides of the carton with respect to the product or products being packaged, the tab is creased or scored by way of a twin bladed rotary creaser. This permits the accurate folding of the tab with respect to the slot to lock the closure panels in their adjusted positions.

Also, in order to assure alignment of the projecting tab with respect to the cutout for the automatic passage of the tab through the cutout, the male panel is provided with an intermediate transverse score or crease which permits folding of the male panel as is necessary to align the projecting tab with the cutout.

With the above and other objects in view that will hereinafter appear, the nature of the invention will be more clearly understood by reference to the following detailed description, the appended claims, and the several views illustrated in the accompanying drawing.

IN THE DRAWINGS

FIG. 4 is a perspective view showing the projecting tab inserted through the cutout.

FIG. 5 is an end elevational view showing the assembled panels and locking tab in position relative to a spring steel product support and with rotated positions of the projecting tab and the female panel terminal portion showing phantom lines.

FIG. 8 is an end elevational view similar to FIG. 5 but with the projecting tab being transversely creased and being folded along with each of the creases towards a locking position.

FIG. 9 is another end elevational view of the carton showing the carton substantially locked, the final locking position of the projecting tab being shown in phantom lines.

DESCRIPTION OF THE INVENTION

Figure 1:
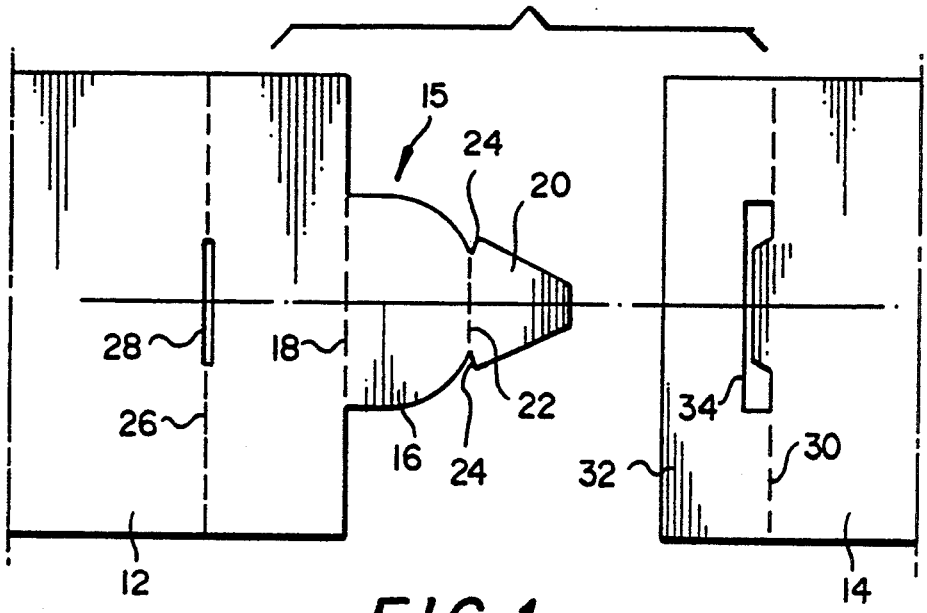
FIG. 1 is an exploded perspective view of the panels and lock features of a typical wrap around carton having a lock in accordance with this invention.

Referring now to the drawings in detail, reference is first made to FIG. 1 wherein a closure panel arrangement of a conventional wrap around carton is illustrated, the closure panel arrangement being generally identified by the numeral 10. The closure panel arrangement 10 includes a male panel ! 2 and female panel 14.

The male panel 12 is provided with a terminal projecting tab 15 which includes a body 16 connected to the male panel 12 along a transverse score or fold line 18. The tab 15 also includes a nose 20 which is joined to the body 16 along another transverse score or fold line 22. The relationship of the nose 20 and the body 16 is one so as to provide a pair of locking ears 24 on the nose 20.

For a purpose to be described in detail hereinafter, the male panel 12 is provided with a transverse score or fold line 26. The male panel 12 is also provided with a transversely extending slot 28 which is preferably along the fold line 26.

The female panel 14 is provided with an interrupted score or fold line 30 defining a terminal female panel portion 32. The panel portion 32 is, in turn, provided immediately adjacent the score 30 with a cutout 34.

As is best shown in FIG. 9, the male panel 12 and the female panel 14 are intended to form a locked closure panel or wall 36 of a wrap around type carton generally identified by the numeral 38. The male panel 12 is carried by one side wall 40 of the carton 38 while the female panel 140 is carried by a second side wall 42 of the carton 38.

Figure 2:
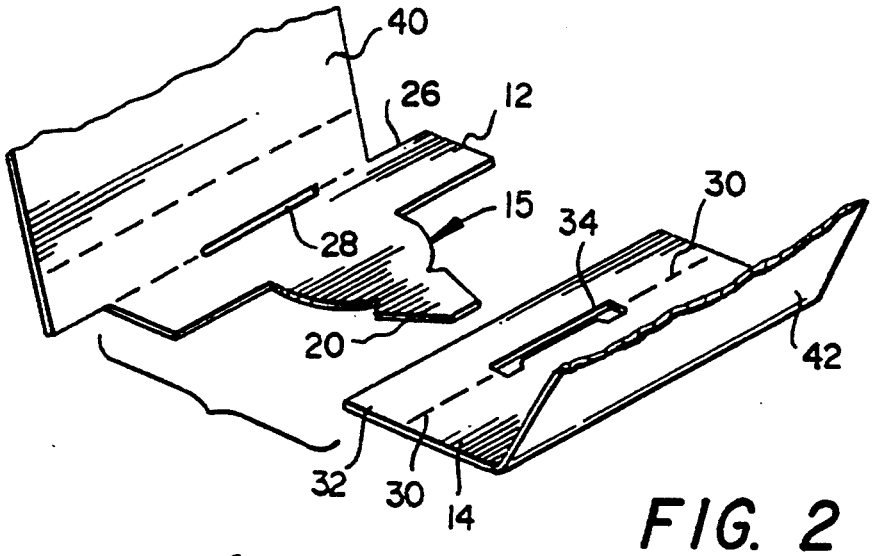
FIG. 2 is an exploded perspective view showing the male panel and female panel folded generally to positions to permit the operation of the lock.

In the application of the carton 38 to a group of containers, articles to be packaged and other products, the carton 38 is seated on the product to be packaged after which the side walls 40, 42 are folded down on opposite sides of that product. Thereafter, the male panel 12 and the female panel 14 are folded relative to the respective side walls 40, 42 as is best shown in FIG. 2. In view of the fact that the projecting tab 15 is gradually swung inwardly it is necessary that the projecting tab be elevated to make certain that it passes through the cutout 34. In order to effect this, the male panel is slightly folded, as shown in FIG. 2, along the transverse fold line 26.

Figure 3:
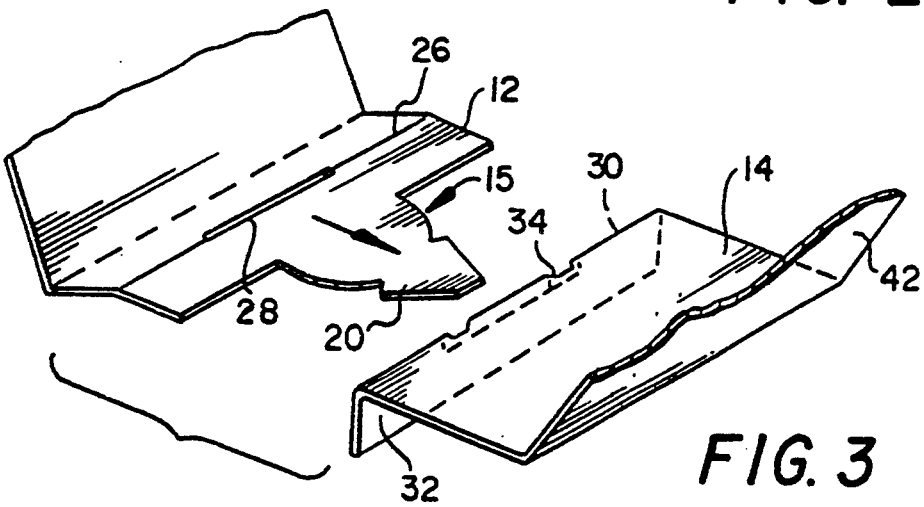
FIG. 3 is an exploded perspective view similar to FIG. 2 but with the female panel terminal portion folded down to expose the cutout for reception of the projecting tab.

As is best shown in FIG. 3, the female panel terminal portion 32 is folded downwardly along the transverse fold line 30 so as to place the cutout 34 in a position opening towards the nose 20 of the projecting tab 15.

Figure 7:
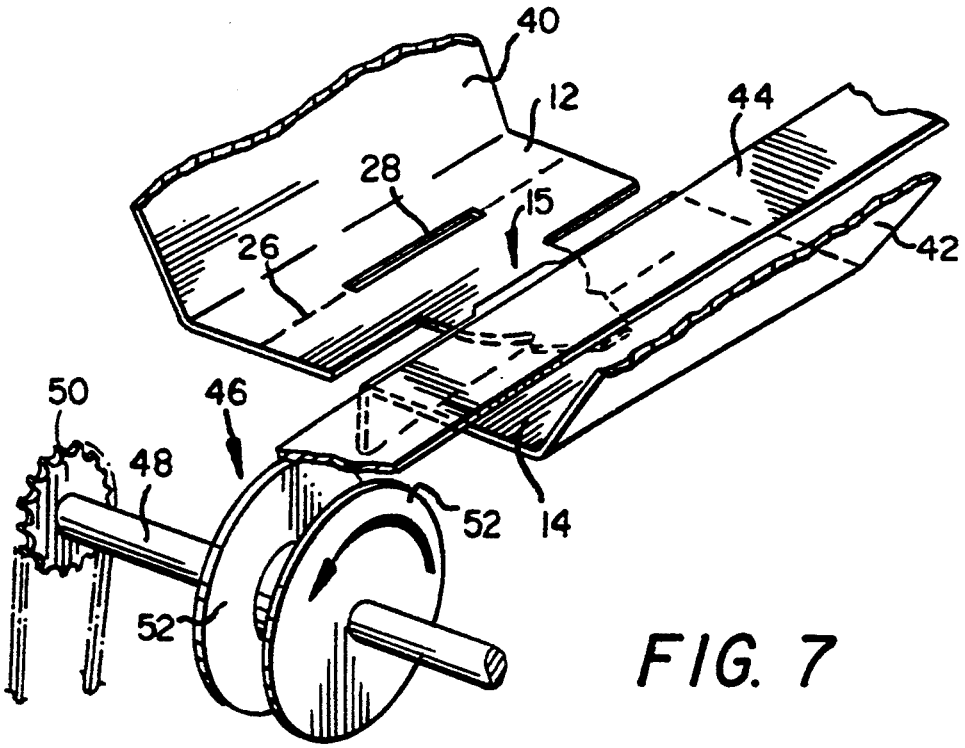
FIG. 7 is a perspective view showing further the relationship of the scoring disc or blade arrangement in conjunction with the spring steel product support and the partially assembled and locked carton.

The male panel 12 and the female panel 14 are continued to be moved together with the tab 15 gradually passing through the cutout until the side walls 40, 42 are tightly pressed against the product or products being packaged. This is clearly shown in FIG. 5. Further, it will be seen that the lock between the male panel 12 and the female panel 14 underlies a spring steel strip 44 which serves to support the articles being packaged as the articles and the carton 10 are moving longitudinally of the strip 44 as is best shown in FIG. 7.

It will be seen that there is associated with the strip 44 a scoring or creasing unit generally identified by the numeral 46. The unit 46 includes a rotating or driven shaft 48 which is suitably driven by way of a sprocket 50. The shaft 48 carries a pair of scoring discs 52 which are spaced along the driven shaft 48 a distance greater than the width of the spring steel strip 44 and generally centered relative thereto.

Figure 6:
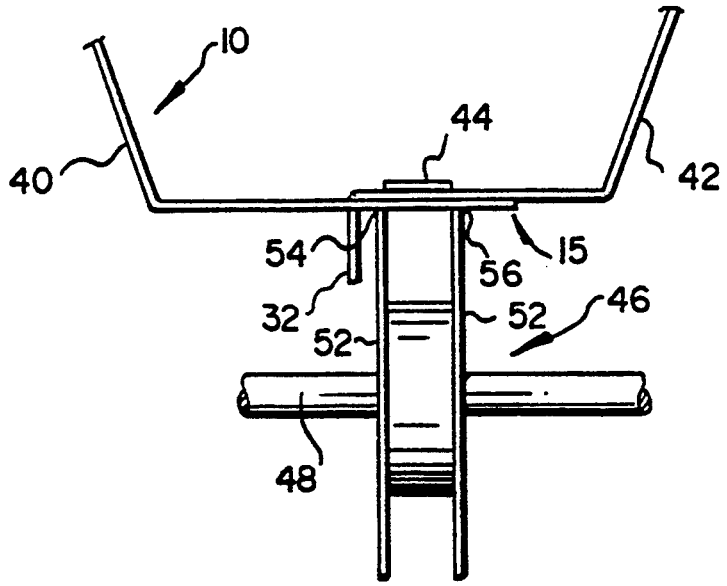
FIG. 6 is an end elevational view similar to FIG. 5 showing the projected tab being transversely scored or creased by way of a rotary twin bladed scoring device.

As is best shown in FIG. 6, the discs 52 serve to provide the projecting tab with a pair of transverse scores or creases 54, 56. The position of the scores 54, 56 along the tab 15 varies in accordance with the spacing of the bottom edges of the side walls 40, 42.

Referring now to FIG. 8, it will be seen that the projecting tab 15 is first folded downwardly along the transverse crease 54 and then is further folded, picking up the panel portion 32.

It is preferred that the crease 56 be in the position of the fold line 22 shown in FIG. 1 with the nose 20 next being folded upwardly about the panel portion 32 and into the slot 28 as is shown in phantom lines in FIG. 8 and in solid lines in FIG. 9. The nose 20 has a final upright position as shown in dotted lines in FIG. 9.

It will be readily apparent from the foregoing that with the specific lock which is the subject of this invention, a tight package can be obtained in each and every instance.

Although only a preferred embodiment of the lock has been specifically illustrated and described herein, it is to be understood that minor variations may be made in the lock without departing from the spirit and scope of the invention as defined by the appended claims.

I claim:

1. A panel lock comprising a male panel and a female panel, said male panel having a free edge terminating in a projecting tab, said female panel having a terminal portion connected to a remainder of said female panel along a fold line, and said female panel having a cutout formed in said female panel terminal portion along said fold line, said projecting tab passing through said cutout and being reversely folded against said female panel terminal portion to clamp said female panel terminal portion against said male panel in face to face relation.

2. A panel lock in accordance with claim 1 wherein in an intermediate stage of locking together said male panel and said female panel, said female panel terminal panel portion is rotated out of a plane of said female panel to expose said cutout towards said male panel, and said projecting tab is passed through said cutout prior to said projecting tab being reversely folded.

3. A panel lock in accordance with claim 2 wherein said male panel has a slot spaced from said projecting tab and being disposed parallel to said fold line, and said projecting tab is passed through said slot.

4. A panel lock according to claim 3 wherein said projrcting tab includes a base portion and a nose portion, and only said nose portion is passed through said slot.

5. A panel lock in accordance with claim 1 where said male panel has a slot spaced from daid projecting tab and being disposed parallel to said fold line, and said projecting tab is passed through said slot.

6. A panel lock in accordance with claim 5 where said projecting tab includes a base portion and a nose portion, and only said nose portion is passed through said slot.

7. A panel lock in accordance with claim 2 wherein said male panel has a fold line parallel to said female panel fold line forming means for aligning said tab with said cutout.

8. A panel lock comprising a male panel and a female panel, said male panel having a free edge terminating in a projecting tab, said female panel having a terminal portion connected to a remainder of said female panel along a fold line, and said female panel having a cutout formed in said female panel terminal portion generally along said fold line, in an intermediate stage of locking together said male panel and said female panel, said female panel terminal portion is rotated out of a plane of said female panel to expose said cutout towards said male panel, and said projecting tab is passed through said cutout, said male panel having a slot spaced from said projecting tab and being disposed parallel to said fold line, said projecting tab including a base portion and a nose portion, said base portion in a final locking stage of said tab having first folded on the order of 180° and said tab having been further folded and projected through said slot with said female panel terminal portion having been folded flat against said male panel by the folding of said projecting tab.

9. A panel lock according to claim 8 wherein said foldings of said tab has been effected along score lines.

10. A panel lock according to claim 9 wherein said score lines have been formed after the final relationship of said male panel and said female panels have been established in said intermediate stage.

11. A panel lock according to claim 10 wherein said male panel, said female panel and said tab combine to define a closure panel.

12. A method of forming a locked closure panel, said method comprising the steps of providing a male panel and a female panel, providing said male panel with an intermediate transverse slot and a projecting terminal locking tab, providing said female panel with a terminal panel portion and providing said terminal panel portion with a cutout, folding said terminal panel portion generally at right angles to a remainder of said female panel, folding said male panel and said female panel towards a common plane, passing said tab through said cutout and generally parallel to said female panel and reversely folding said tab and through said slot while folding said terminal panel under said male panel.

13. A method according to claim 12 wherein said male panel is provided with a transverse fold line for folding said male panel into two parts to align said tab with said cutout.

14. A method according to claim 12 together with the step of transversely scoring said tab after said tab has been passed through said cutout to define transverse fold lines in said tab.

* * * * *